US009468312B2

(12) United States Patent
Denby

(10) Patent No.: US 9,468,312 B2
(45) Date of Patent: Oct. 18, 2016

(54) DISPLAY FIXTURE WITH CANTILEVERED SHELF

(71) Applicant: Target Brands, Inc., Minneapolis, MN (US)

(72) Inventor: Scott E. Denby, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/599,683

(22) Filed: Jan. 19, 2015

(65) Prior Publication Data

US 2016/0206119 A1 Jul. 21, 2016

(51) Int. Cl.

| | |
|---|---|
| ***A47F 5/00*** | (2006.01) |
| ***A47F 8/00*** | (2006.01) |
| ***A47F 5/10*** | (2006.01) |
| ***A47F 5/13*** | (2006.01) |
| ***A47B 96/02*** | (2006.01) |

(52) U.S. Cl.

CPC ..... *A47F 5/0043* (2013.01); *A47B 96/021* (2013.01); *A47F 5/10* (2013.01); *A47F 5/103* (2013.01); *A47F 5/108* (2013.01); *A47F 5/137* (2013.01); *A47F 8/00* (2013.01)

(58) Field of Classification Search

CPC ..... A47F 5/0043; A47F 8/00; A47F 5/10

USPC ..... 211/90.01, 90.02, 94.01, 162, 190, 189, 211/204, 186, 187; 108/106–108, 147.11, 108/147, 17, 157.1, 157.16, 158

See application file for complete search history.

(56) References Cited

U.S. PATENT DOCUMENTS

| | | | | | |
|---|---|---|---|---|---|
| 754,816 | A * | 3/1904 | Schriefer | A47B 57/16 | 108/109 |
| 1,753,725 | A * | 4/1930 | Solomon | A47G 25/0678 | 211/182 |
| 2,065,116 | A * | 12/1936 | Constantine | F25D 25/021 | 108/26 |
| 2,633,318 | A * | 3/1953 | Caples | A45F 3/44 | 108/147.11 |
| 2,790,559 | A * | 4/1957 | Stephenson | A47B 96/028 | 108/108 |
| 2,837,219 | A * | 6/1958 | Ferdinand | A47B 57/485 | 108/185 |
| 2,845,187 | A * | 7/1958 | Bianchi | A47B 57/425 | 108/147.17 |
| 3,044,634 | A * | 7/1962 | Oztekin | A47B 96/02 | 108/108 |
| 3,085,693 | A * | 4/1963 | Shell | A47B 57/425 | 211/134 |
| 3,100,460 | A * | 8/1963 | McElroy | A47B 57/16 | 108/109 |
| 3,104,627 | A * | 9/1963 | Fohn | A47B 57/22 | 108/157.13 |

(Continued)

OTHER PUBLICATIONS

Image of Shelf, publicly available at least as early as Oct. 30, 2014, 1 page.

(Continued)

*Primary Examiner* — Joshua J Michener
*Assistant Examiner* — Devin Barnett
(74) *Attorney, Agent, or Firm* — Leanne Taveggia Farrell; Westman, Champlin & Koehler, P.A.

(57) ABSTRACT

A display fixture includes a display structure having at least two uprights and at least one cross bar that spans between the at least two uprights. At least one shelf is mounted on the at least one cross bar and includes a deck, a pair of side panels each located on opposing sides of the deck and each having a slot and an elongated channel extending between the pair of slots in the pair of side panels. Each slot is separated from a back edge of each side panel. The channel is defined by a front that extends between front edges of the pair of slots, a back that extends between back edges of the pair of slots and a top that extends between upper edges of the pair of slots. The pair of slots and the channel engage with the cross bar.

15 Claims, 8 Drawing Sheets

(56) References Cited

U.S. PATENT DOCUMENTS 3,168,365 A * 2/1965 Evans ..... A47B 57/16 108/109
3,323,656 A * 6/1967 Weiss ..... A47B 96/021 108/152
3,381,636 A 5/1968 Saiberlich
3,391,797 A * 7/1968 Baldwin ..... A47B 47/03 108/107
3,503,525 A * 3/1970 Loebner ..... A47F 5/13 182/153
3,556,306 A * 1/1971 Shell ..... A47B 96/021 108/108
3,602,372 A * 8/1971 Verrecchio ..... A47F 7/065 206/8
3,698,565 A 10/1972 Weber
3,730,108 A * 5/1973 Stroh ..... A47B 45/00 108/108
3,960,275 A * 6/1976 Haughton ..... A47F 5/13 108/158.12
4,098,480 A * 7/1978 Neumann ..... A47B 96/028 211/153
4,139,247 A * 2/1979 Karashima ..... A47B 96/027 108/137
4,150,753 A * 4/1979 Stahl ..... A47F 5/13 211/105.1
4,154,419 A * 5/1979 Breidenbach ..... A47B 57/402 108/110
4,228,906 A 10/1980 Jones
4,299,367 A 11/1981 Harlan
4,316,547 A * 2/1982 Varon ..... A47G 25/0692 211/105.1
4,349,113 A 9/1982 Schreiner
4,401,222 A * 8/1983 Kulikowski ..... A47F 5/0025 211/103
4,501,369 A * 2/1985 Fox ..... A47B 57/26 108/147.12
4,542,702 A * 9/1985 Johansson ..... A47B 57/485 108/109
4,711,183 A * 12/1987 Handler ..... A47B 57/402 108/107
D294,543 S * 3/1988 Rekow ..... D6/681.3
4,760,930 A * 8/1988 Fox ..... A47B 96/027 211/153
4,762,688 A * 8/1988 Berry, Jr. ..... A61L 2/26 206/349
4,843,977 A 7/1989 Bridges
4,850,285 A * 7/1989 Suttles ..... A47F 5/103 108/108
4,871,076 A * 10/1989 Schramm ..... A47F 5/13 211/182
4,955,490 A * 9/1990 Schafer ..... A47B 96/02 211/187
D318,194 S * 7/1991 Terrell ..... D6/681.2
D319,934 S * 9/1991 Terrell ..... D6/675.1
5,054,729 A * 10/1991 Mogi ..... A45D 44/14 248/118
5,257,701 A * 11/1993 Edelson ..... A47B 3/10 108/116
5,272,991 A 12/1993 Carrigan, Jr.
5,392,934 A * 2/1995 Fox ..... A47B 95/008 211/103
5,433,152 A * 7/1995 Henry ..... A47K 10/04 108/42
5,454,638 A * 10/1995 Bird ..... A47B 57/42 108/108
5,509,541 A * 4/1996 Merl ..... A47B 45/00 211/103
5,526,941 A * 6/1996 Ford ..... A47F 5/0876 211/103
5,582,376 A * 12/1996 Thompson ..... A47F 5/0846 211/94.01
5,617,797 A * 4/1997 Casey ..... A47B 45/00 108/42
5,617,962 A * 4/1997 Chen ..... A47G 25/0664 211/204
5,665,304 A * 9/1997 Heinen ..... A47F 1/126 108/110
5,695,078 A * 12/1997 Otema ..... A47B 57/045 108/108
D394,360 S * 5/1998 Geier ..... D34/21
5,769,247 A * 6/1998 Merl ..... A47B 47/022 211/103
5,855,283 A * 1/1999 Johnson ..... A47F 1/126 211/103
5,908,119 A * 6/1999 Kump ..... A47F 5/0068 211/113
6,029,833 A * 2/2000 Yeh ..... A47F 5/0838 108/108
6,032,589 A * 3/2000 Wang ..... F16M 7/00 108/147.11
D455,585 S 4/2002 West
D466,331 S * 12/2002 Chang ..... D6/681.1
D470,685 S * 2/2003 Chang ..... D6/681.1
6,526,897 B1 * 3/2003 Ondrasik ..... A47F 5/01 108/107
6,557,711 B2 * 5/2003 Grueneberg ..... A47F 5/0068 211/119.003
6,561,365 B2 * 5/2003 Bustos ..... A47F 5/0018 211/187
6,575,315 B2 6/2003 Zidek
6,644,484 B1 * 11/2003 Sardis ..... A47B 43/00 211/189
6,669,037 B1 * 12/2003 Ahn ..... A47F 5/137 211/189
6,802,485 B1 * 10/2004 Cassidy ..... A47B 19/002 211/135
6,846,043 B1 * 1/2005 Leoutsakos ..... A47C 16/025 108/147.11
6,935,523 B2 8/2005 Ahn
D521,286 S 5/2006 Colmenares
7,270,385 B2 * 9/2007 Mathur ..... A47B 96/025 108/108
D572,056 S 7/2008 McConnell
7,438,268 B2 * 10/2008 Kologe ..... A47F 5/0838 248/220.22
D602,713 S * 10/2009 Stukenberg ..... D6/681.1
7,644,527 B2 * 1/2010 Clark ..... A47F 5/137 211/206
D609,510 S 2/2010 Stafford et al.
7,690,519 B2 4/2010 Kahl et al.
D622,084 S * 8/2010 Stukenberg ..... D6/682.6
D643,656 S 8/2011 Golias, Sr. et al.
8,028,845 B2 * 10/2011 Himes ..... A47B 47/021 211/103
8,028,846 B2 * 10/2011 Peota ..... A47B 91/00 108/108
8,061,539 B2 * 11/2011 Punzel ..... A47B 47/021 108/108
D660,059 S 5/2012 Nilsson
8,172,347 B2 * 5/2012 Lim ..... F25D 25/02 108/106
8,210,367 B2 7/2012 Nagel et al.
D677,502 S * 3/2013 Ryan ..... D6/707.22
8,608,264 B2 12/2013 Wing
D701,408 S 3/2014 Mason et al.
D705,585 S 5/2014 Kim
D705,586 S 5/2014 Denby et al.
8,720,702 B2 5/2014 Nagel
D707,067 S 6/2014 Basarich et al.
8,777,022 B2 * 7/2014 Artigues ..... A47B 61/003 211/187
8,875,910 B2 * 11/2014 Wurr ..... A47B 57/50 211/187
D718,966 S 12/2014 Bennie et al.
8,936,166 B2 * 1/2015 Hornsby ..... A47G 25/0685 211/182
D724,876 S 3/2015 Gokhale et al.
8,967,402 B2 * 3/2015 Pintur ..... A47F 5/0018 211/103
9,016,484 B2 * 4/2015 Kologe ..... A47F 1/125 211/59.3
D728,286 S 5/2015 Leinberger
D733,473 S 7/2015 Troyner et al.
9,119,487 B2 * 9/2015 Angvall ..... A47F 5/0081
9,282,816 B2 * 3/2016 Ahart ..... A47B 47/0091

(56) References Cited

U.S. PATENT DOCUMENTS

2001/0042495 A1* 11/2001 Salmanson ..... A47B 57/22 108/110
2003/0034320 A1* 2/2003 Noh ..... A47F 5/10 211/189
2003/0051643 A1* 3/2003 Remmers ..... A47B 55/02 108/147.17
2003/0131772 A1* 7/2003 Green ..... D05C 15/16 112/80.6
2006/0180561 A1* 8/2006 Wisnoski ..... A47F 5/0846 211/94.01
2006/0243688 A1* 11/2006 Gilcrest ..... A47B 95/008 211/87.01
2006/0278136 A1* 12/2006 Sinclair ..... A47D 3/00 108/24
2007/0138114 A1* 6/2007 Dumontet ..... A47F 1/126 211/59.3
2007/0163974 A1* 7/2007 Lai ..... A47G 25/0664 211/85.3
2007/0170139 A1* 7/2007 Clark ..... A47F 5/137 211/189
2007/0181515 A1 8/2007 Levi et al.
2007/0221103 A1* 9/2007 Trausch ..... A47B 57/045 108/108
2007/0272642 A1* 11/2007 Baptiste ..... A47B 43/00 211/201
2008/0053931 A1* 3/2008 Newbould ..... A47B 96/067 211/88.01
2008/0078728 A1* 4/2008 Hodge ..... A47F 7/144 211/55
2009/0250422 A1* 10/2009 Clark ..... A47F 5/103 211/189
2010/0116760 A1 5/2010 Fazzone
2013/0134842 A1 5/2013 Kassanoff et al.
2013/0248476 A1 9/2013 Barenbrugge
2013/0256253 A1 10/2013 Stuby
2014/0027397 A1 1/2014 Knoll et al.
2014/0068959 A1* 3/2014 Kim ..... A45D 20/08 34/97
2014/0259831 A1* 9/2014 Denby ..... A47F 5/10 40/606.03
2015/0313359 A1* 11/2015 Bennie ..... A47B 47/0066 211/135
2015/0335155 A1 11/2015 Winker
2016/0051044 A1 2/2016 Sabounjian
2016/0166059 A1 6/2016 Zohar et al.

OTHER PUBLICATIONS

U.S. Appl. No. 29/514,946, filed Jan. 19, 2015, entitled Display Shelf, 4 pages.

* cited by examiner

DISPLAY FIXTURE WITH CANTILEVERED SHELF

BACKGROUND

Businesses, such as retail stores, use a variety of types of display fixtures to present and display products to customers for purchase. Often display fixtures include display structures having upright and/or vertical frame members. For example, a cross bar can be mounted to a pair of upright frame members to support merchandise. Shelves are also mounted to display structures using brackets that are connected to the upright frame members.

The discussion above is merely provided for general background information and is not intended to be used as an aid in determining the scope of the claimed subject matter.

SUMMARY

A display fixture includes a display structure having at least two uprights and at least one cross bar that spans between the at least two uprights. At least one shelf is toolles sly mounted on the at least one cross bar and includes a deck, a pair of side panels each located on opposing sides of the deck and each having a slot and an elongated channel extending between the pair of slots in the pair of side panels. Each slot is separated from a back edge of each side panel. The channel is defined by a front that extends between front edges of the pair of slots, a back that extends between back edges of the pair of slots and a top that extends between upper edges of the pair of slots. The pair of slots and the elongated channel engage with the cross bar without any additional hardware so that the shelf is cantilevered from the cross bar to support merchandise.

A display fixture includes at least two upright support members, at least one substantially horizontal rail having a first end that mounts to one of the upright support members and a second end that mounts to another of the upright support members, at least one shelf including a main shelf body and a u-channel coupled to an underside of the main shelf body and extending a width of the main shelf body. The u-channel is engaged with the at least one substantially horizontal rail so that the at least one shelf is cantilevered from the at least one substantially horizontal rail. A right side of the u-channel is aligned with an opening in a right side frame member of the at least one shelf, a left side of the u-channel is aligned with an opening in a left side frame member of the at least one shelf, a front of the u-channel extends between front edges of the openings in the right side frame member and the left side frame member, a back of the u-channel extends between back edges of the openings in the right side frame member and the left side frame member. The u-channel is spaced apart from a back edge of the shelf and in closer proximity to the back edge of the shelf than a front of the shelf.

A method is provided for displaying merchandise on a display fixture. At least one cross bar is mounted to a display structure by inserting a first bracket on a first end of the cross bar into holes in a first upright of the display structure and inserting a second bracket on a second end of the cross bar into holes in a second upright of the display structure. A shelf having a deck, a right side frame member, a left side frame member and a front side frame member is mounted to the cross bar by engaging a channel located on an underside of the deck with the cross bar without any additional hardware. The channel is defined by a front that extends between a front edge of an opening in the right side frame member and a front edge of an opening in the left side frame member, a back that extends between a back edge of the opening in the right side frame member and a back edge of the opening in the left side frame member and a top that extends between an upper edge of the opening in the right side frame member and an upper edge of the opening in the left side frame member. Merchandise is displayed on the shelf.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A cantilevered shelf is toollessly mounted to a cross bar on a display structure without any additional hardware. Normally, a display shelf is mounted to upright frame members on a display structure with shelf brackets and therefore the display shelf width is dependent on the standard distance between the upright frame members of the display structure. Since the cantilevered shelf, as will be discussed in detail below, is engaged with a cross bar that is mounted to the upright frame members on the display structure, the cantilevered shelf can be any width that is the same or less than a length of the cross bar. In this way, the cantilevered shelf need not be as wide as the length between the upright frame members and the remainder of the cross bar can be used to merchandise other types of product.

Figure 1:
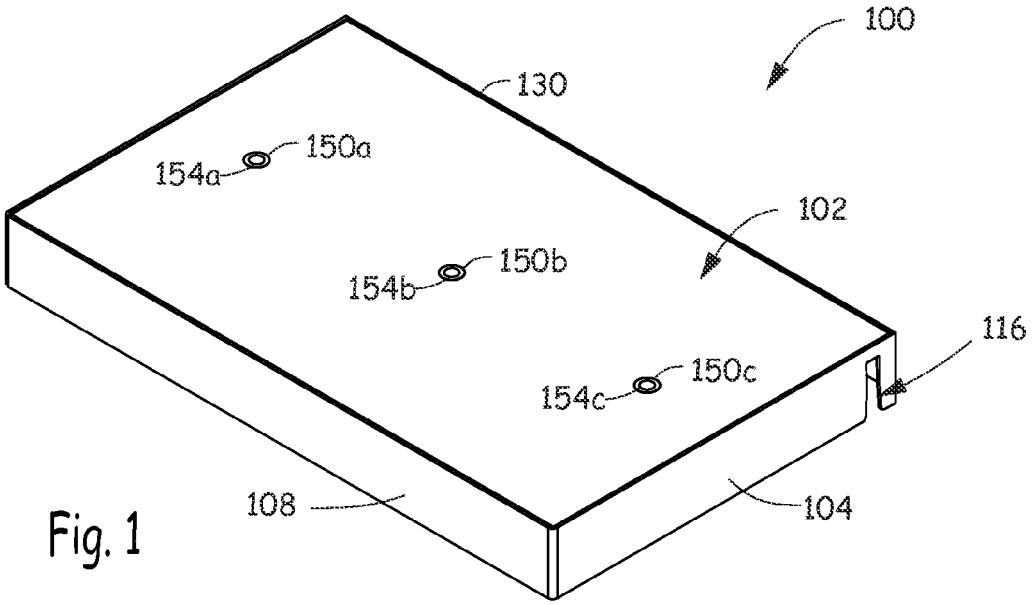
FIG. 1 illustrates a top perspective view of a shelf that is mounted to a cross bar on a display structure without any additional hardware according to one embodiment.
Figure 2:
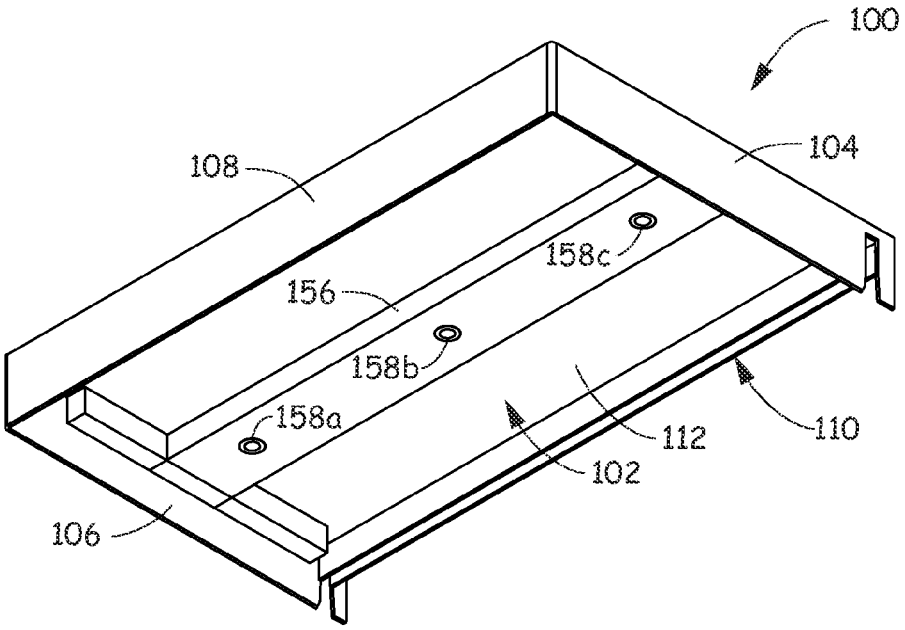
FIG. 2 is a bottom perspective view of the shelf in FIG. 1.
Figure 3:
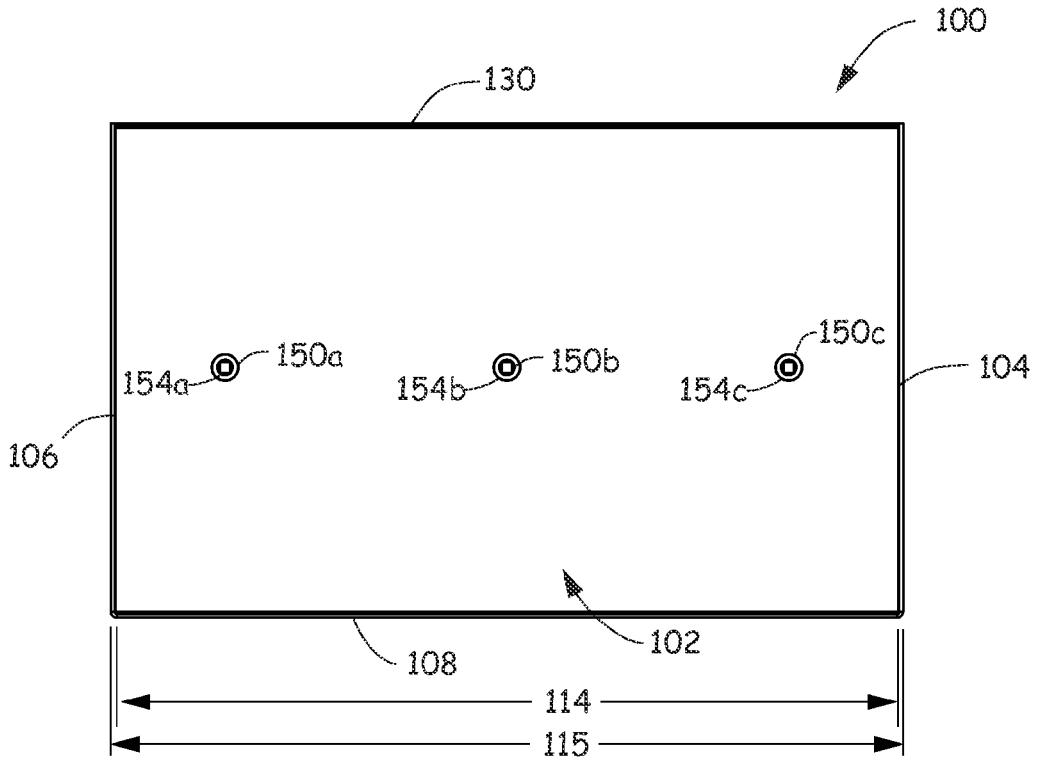
FIG. 3 is a top view of the shelf in FIG. 1.
Figure 4:
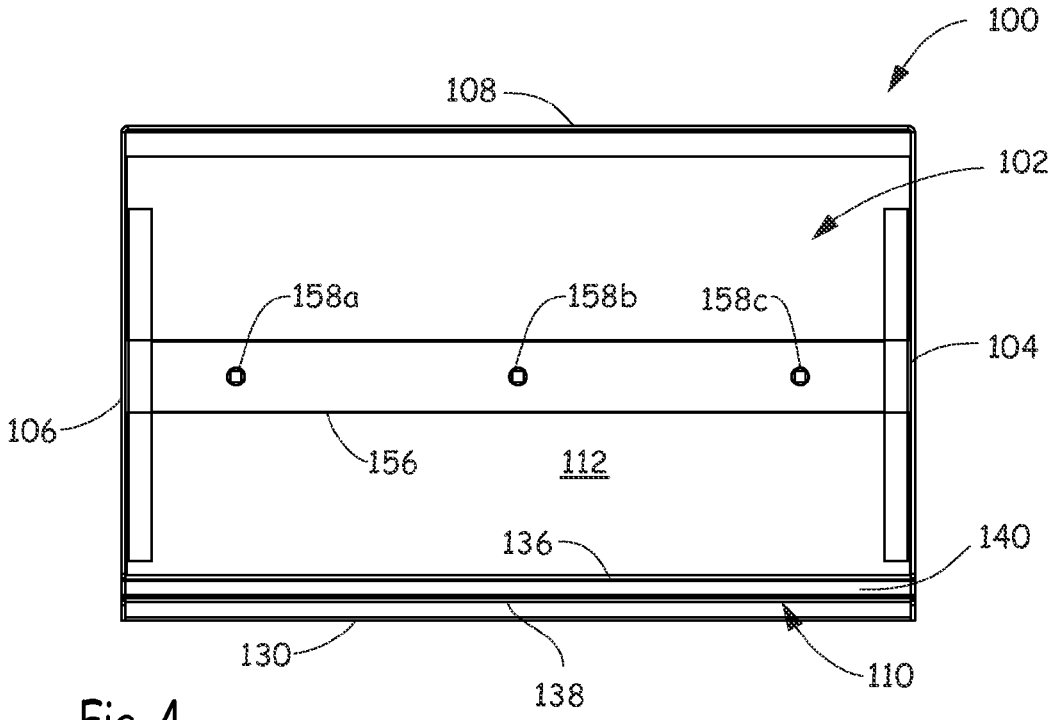
FIG. 4 is a bottom view of the shelf in FIG. 1.
Figure 5:
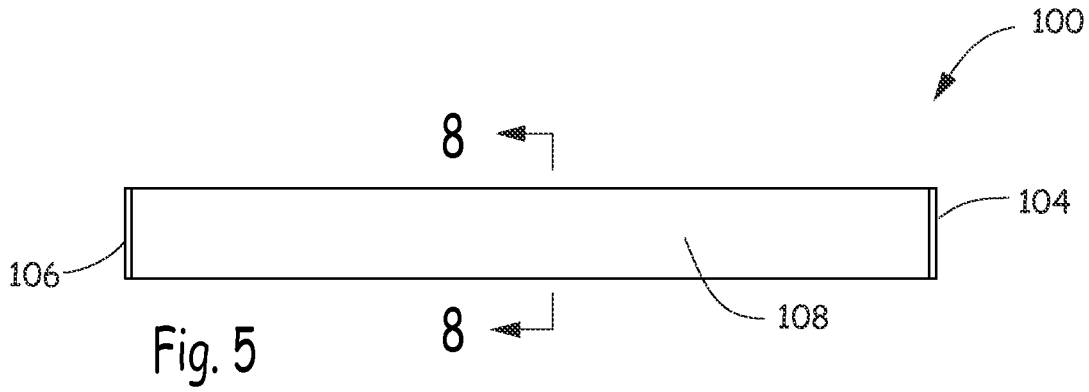
FIG. 5 is a front view of the shelf in FIG. 1.
Figure 7:
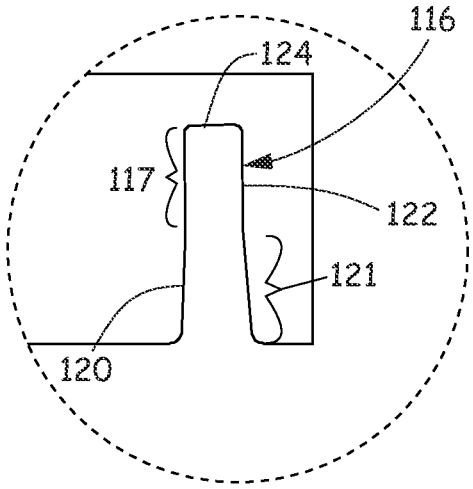
FIG. 7 is an enlarged view of a portion of the right side view in FIG. 6.
Figure 8:
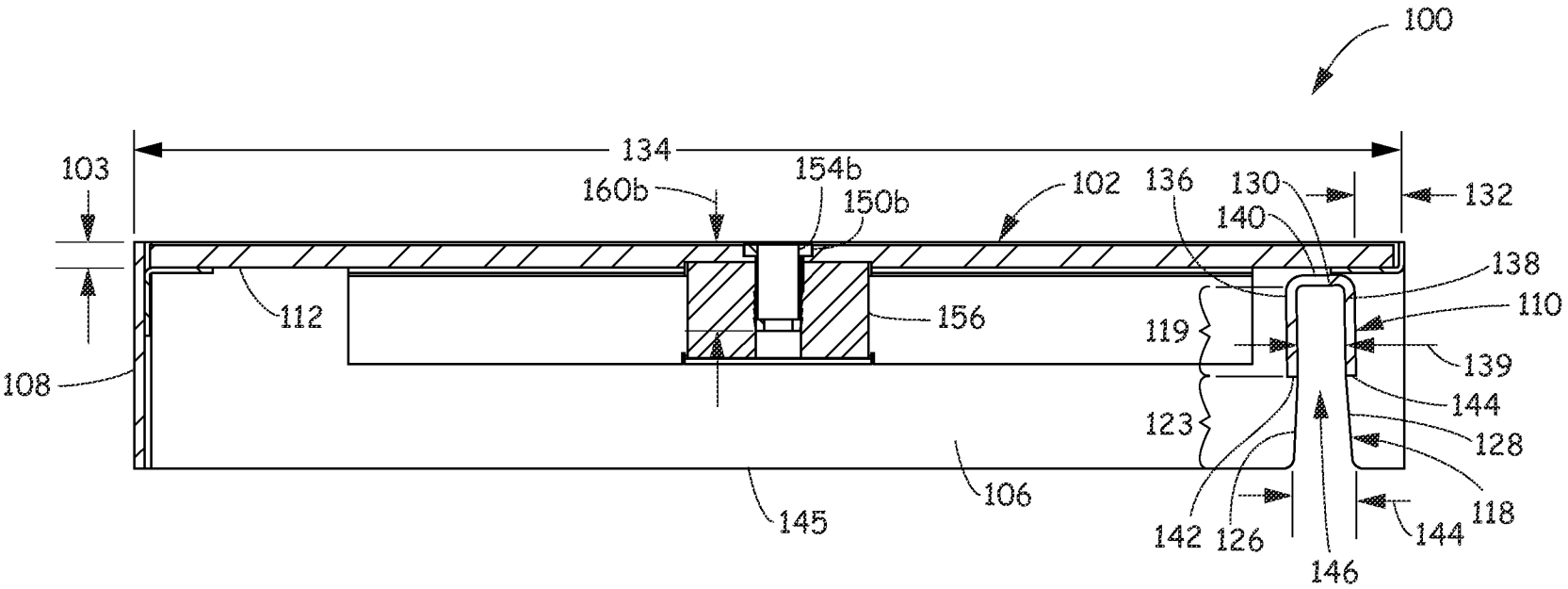
FIG. 8 is a section view of the shelf in FIG. 1 taken through the line indicated in FIG. 5.

FIG. 1 is a top perspective view of a shelf 100 and FIG. 2 is a bottom perspective view of shelf 100. FIGS. 3-6 are a top view, a bottom view, a front view and a right side view, respectively. The left side view is a mirror image of the right side view. FIG. 7 is an enlarged view of a portion of FIG. 6. FIG. 8 is a section view of shelf 100 taken through the line indicated in FIG. 5.

Shelf 100 includes at least a deck or main shelf body 102, a right side frame member or side panel 104, a left side frame member or side panel 106, a front frame member or front panel 108 and a u-channel or elongated channel 110 that is coupled to an underside 112 of deck 102 and extends across a width 114 of deck 102. Right side frame member or side panel 104 and left side frame member or side panel 106 are located on opposing sides of deck or main shelf body 102 and each have an opening or slot.

Figure 6:
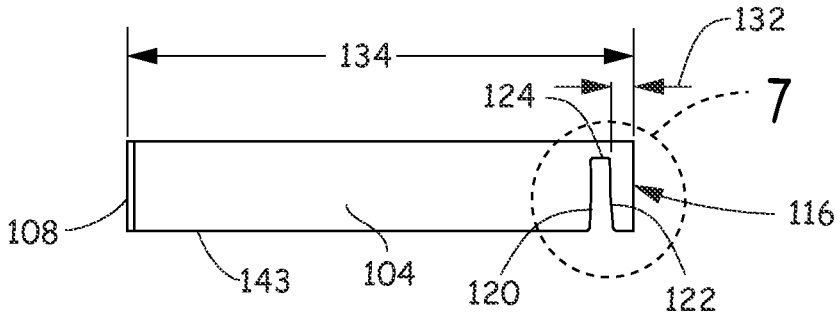
FIG. 6 is a right side view of the shelf in FIG. 1.

Opening or slot 116 is located in right side frame member 104 and includes a front edge 120, a back edge 122 and an upper edge 124 (see FIG. 6). Opening or slot 118 located in left side frame member 106 is substantially identical to opening or slot 116 and includes a front edge 126, a back edge 128 and an upper edge 130 (see FIG. 7). Further, opening 116 includes an upper portion 117 where the distance between front edge 120 and back edge 122 is uniform and a lower portion 121 where the distance between front edge 120 and back edge 122 is non-uniform. Still further, opening 118 includes an upper portion 119 where the distance between front edge 126 and back edge 128 is uniform and a lower portion 123 where the distance between front edge 126 and back edge 128 is non-uniform. In particular, back edges 122 and 128 of lower portions 121 and 123 are tapered from where upper portions 117 and 119 meet lower portions 121 and 123 and to bottom edges 142 and 145 of right and left side frame members 104 and 106. In addition, back edges 122 and 128 of openings 116 and 118 are separated from a back edge 130 of shelf 100 by a space 132 and front edges 120 and 126 of openings 116 and 118 are separated from front frame member 108 of shelf 100 by a space 134. Space 132 is less than space 134.

A right side of u-channel 110 aligns with upper portion 117 of opening 116 in right side frame member 104 and a left side of u-channel 110 aligns with upper portion 119 of opening 118 in the left side frame member 106. Therefore, u-channel 110 extends between openings 116 and 118 in right side frame member 106 and left side frame member 108, respectively, and is defined by a front 136 that extends between front edges 120 and 126 of openings 116 and 117, a back 138 that extends between back edges 122 and 128 of openings 116 and 117 and a top 140 that extends between upper edges 124 and 130 of openings 116 and 117. A distance 139 between front 136 and back 138 is less than a width 141 of openings 116 and 118 of right and left side frame members 104 and 106 at bottom edges 143 and 145 of right and left side frame members 104 and 106.

Between a bottom edge 142 of front 136 and a bottom edge 144 of back 138 is a channel opening 146. Bottom edges 142 and 144 are located above bottom edges 143 and 145 of right side frame member 104 and left side frame member 106, respectively. Channel opening 146 receives a cross bar or substantially horizontal rail on a display structure so that u-channel 110 mounts to or engages with the cross bar or substantially horizontal rail and the cross bar or substantially horizontal rail directly contacts front 136, back 138 and top 140. In addition, openings 116 and 118 in right side frame member 104 and left side frame member 106 also mount to or engage with the cross bar. The engagement of u-channel 110 and openings 116 and 118 with the cross bar is accomplished toollessly and without any additional hardware so that shelf 100 is cantilevered from the cross bar to support merchandise.

Openings 116 and 118 in right side frame member 104 and left side frame member 106 and u-channel 110 are separated from back edge 130 of shelf 100 by space 132 and are in closer proximity to back edge 130 of shelf 100 than to front frame member 108 of shelf 100. This separation in combination with a height of u-channel 110 and heights of openings 116 and 118 in right and left side frame members 104 and 106, contribute to the ability of shelf 110 to be cantilevered from the substantially horizontal rail or cross bar without additional hardware.

Figure 9:
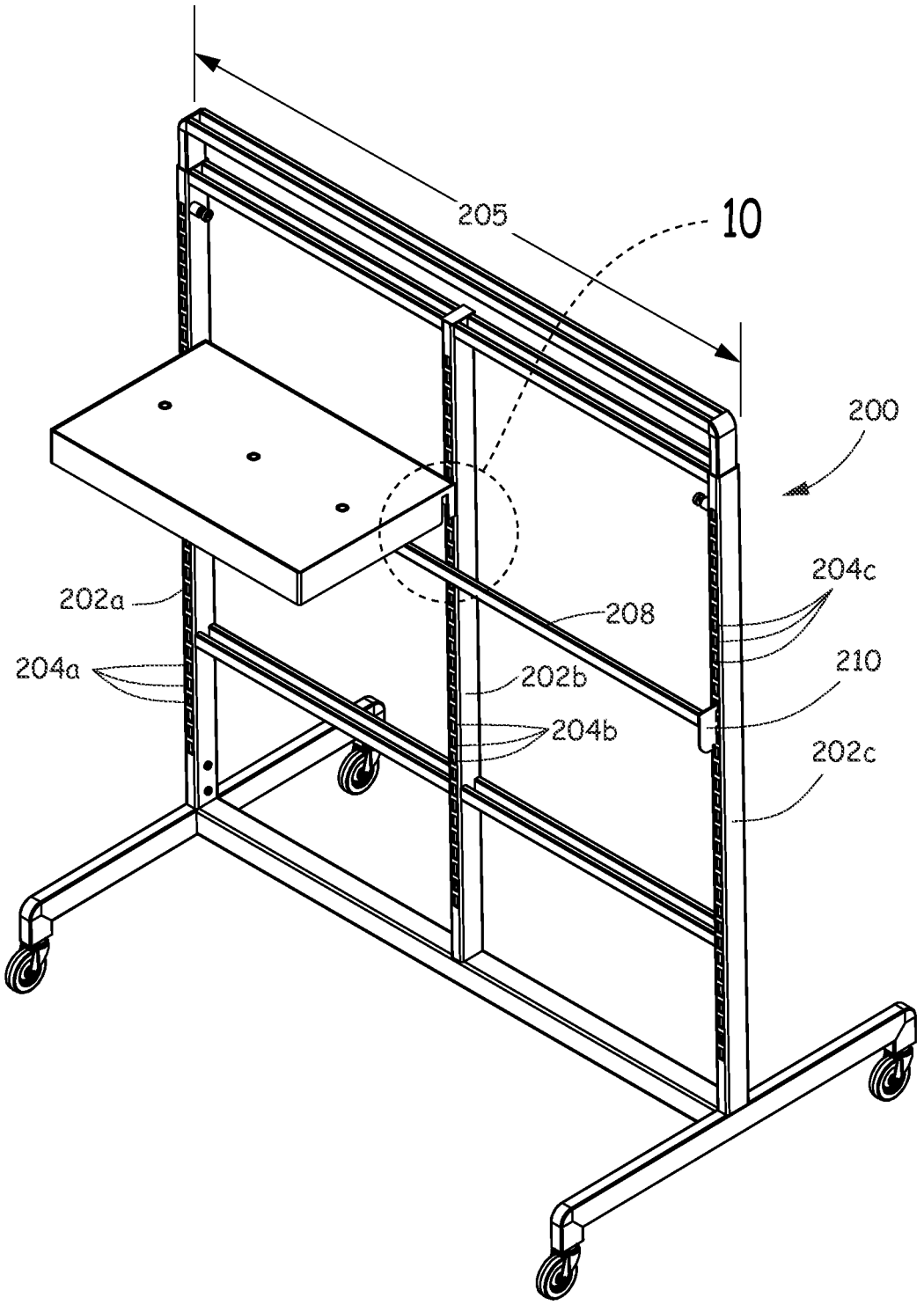
FIG. 9 is a perspective view of the shelf in FIG. 1 being mounted to a display structure according to another embodiment.

FIG. 9 is a perspective view of shelf 100 in FIGS. 1-8 being mounted to an exemplary display structure 200. Exemplary display structure 200 is a rolling rack. The rolling rack is a mobile display structure that includes a plurality of frame members including at least two upright or substantially vertical frame members. In this embodiment, display structure 200 includes three upright frame members 202*a*, 202*b* and 202*c*. Each upright frame member 202*a*, 202*b* and 202*c* includes a plurality of spaced apart holes 204*a*, 204*b* and 204*c*. Each of the plurality of holes 204*a*, 204*b* and 204*c* is capable of receiving a bracket on a cross bar or substantially horizontal rail. In FIG. 9, a cross bar or substantially horizontal rail 208 spans between two upright frame members 202*a* and 202*c*. Upright frame member 202*a* receives a first bracket or first end (not illustrated in FIG. 9) of a cross bar or substantially horizontal rail 208 and upright frame member 202*c* receives a second bracket or second end 210 of cross bar or substantially horizontal rail 208.

Figure 10:
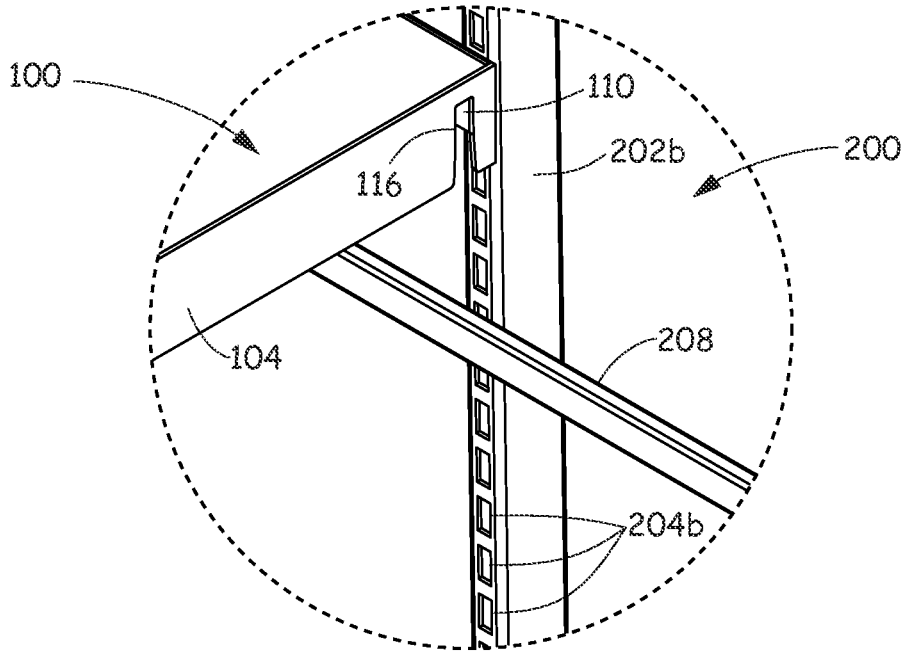
FIG. 10 is an enlarged view of a portion of FIG. 9.

FIG. 10 is an enlarged view of a portion of FIG. 9. As illustrated in both FIG. 9 and FIG. 10, openings 116 and 118 of shelf 100 as well as u-channel 110 are engaged with cross bar 208 without any additional hardware by position au-channel 110 over cross bar 208 and lowering shelf 100 until cross bar 108 is located within u-channel 110. By mounting shelf 100 to cross bar 208 in this manner, shelf 100 can be any width, such as width 115, that is the same or less than the length of cross bar 208 and the same or less than a distance 205 between upright frame members 202*a* and 202*c*. In this way, shelf 100 need not be as wide as the distance between the upright frame members and the remaining length of cross bar 208 can be used to merchandise other product.

Figure 12:
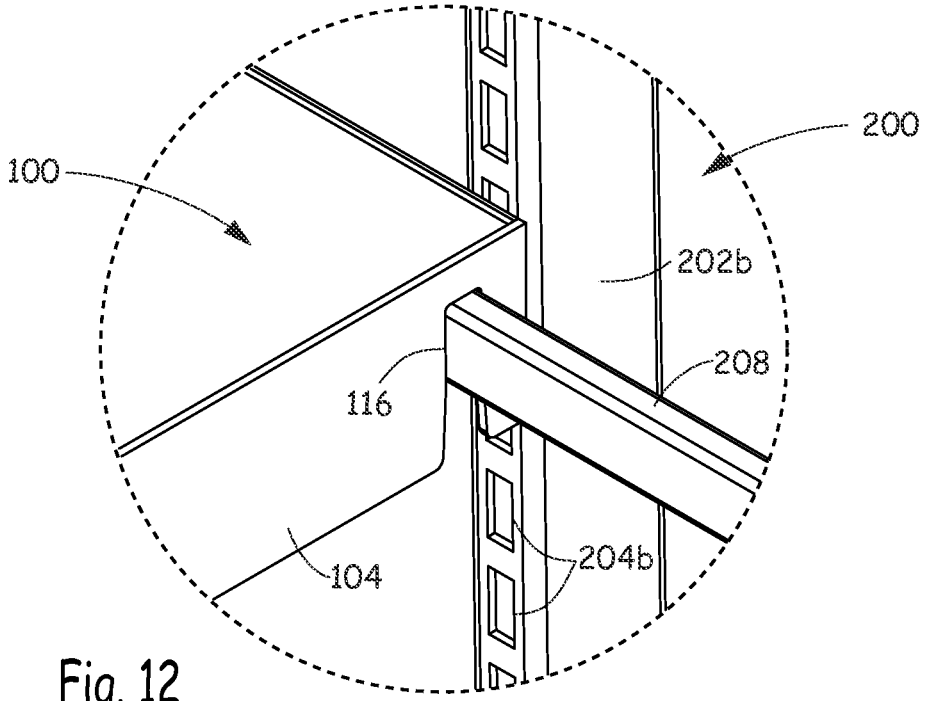
FIG. 12 is an enlarged view of a portion of FIG. 11.
Figure 11:
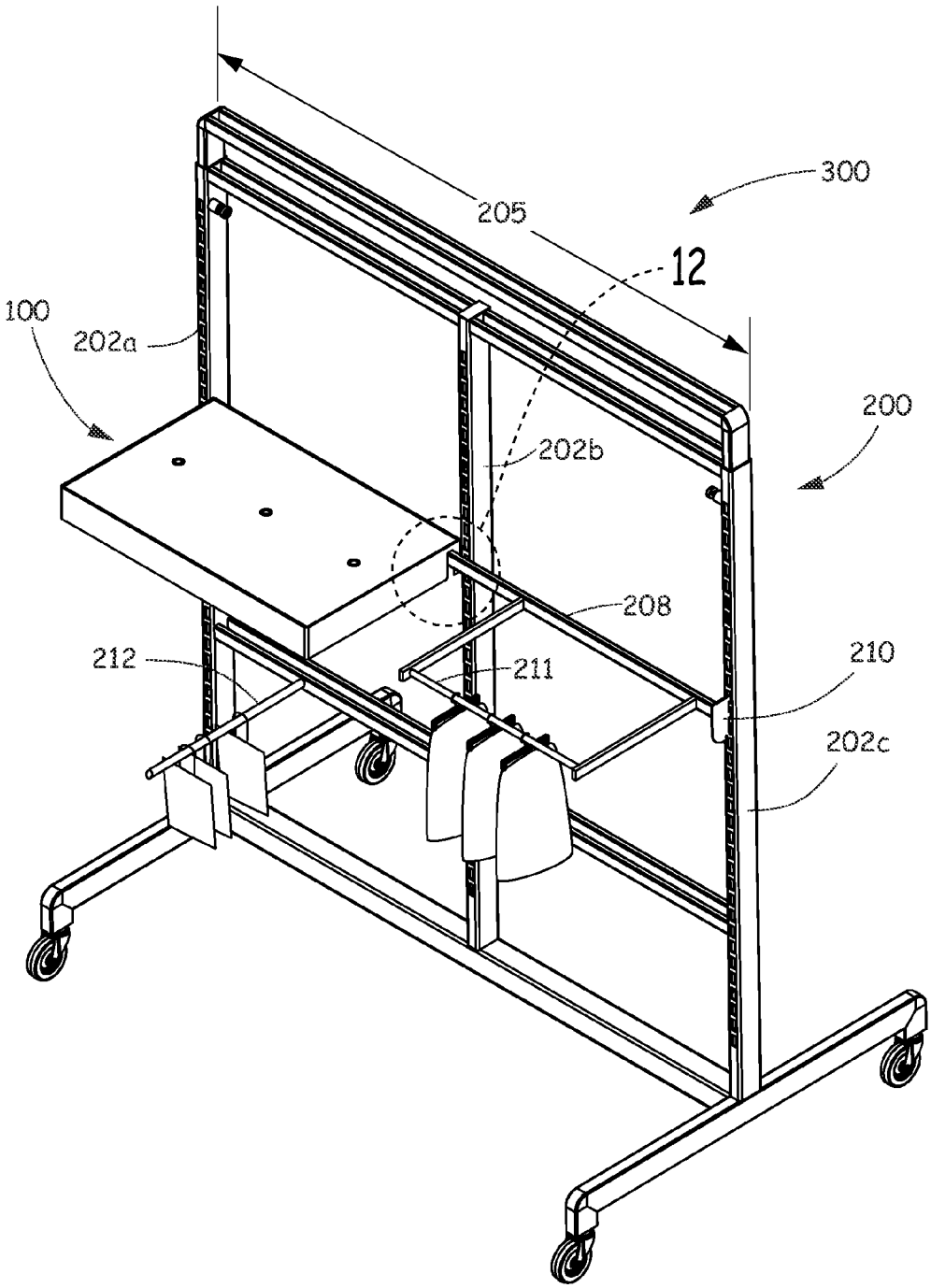
FIG. 11 is a perspective view of the shelf in FIG. 1 mounted to the display structure in FIG. 9 to form a display fixture according to another embodiment.

FIG. 11 is a perspective view of shelf 100 mounted to exemplary display structure 200 in FIG. 9 to form an exemplary display fixture 300 according to another embodiment. FIG. 12 is an enlarged view of a portion of FIG. 11. As illustrated in both FIG. 11 and FIG. 12, openings 116 and 118 of shelf 100 as well as u-channel 110 are engaged with cross bar 208 without any additional hardware. In addition, the width of shelf 100 is less than the length of cross bar 208. This allows for display structure 200 to be outfitted with various display accessories for displaying various types of merchandise. In FIG. 11, a hanger bar 211 is mounted to the remaining length of cross bar 208 and supports hanging merchandise. An additional accessory, which is front facing hanger bar 212, is mounted to a frame member of display structure 200 and supports additional hanging merchandise.

With reference back to FIGS. 1-8, shelf 100 further includes a plurality of apertures 150*a*, 150*b* and 150*c* extending through a thickness 103 of deck or main shelf body 102. While shelf 100 illustrates three apertures 150*a*, 150*b* and 150*c*, it should be realized that any number of apertures are possible. Within each aperture 150*a*, 150*b*, 150*c* is a hollow receiver 154*a*, 154*b* and 154*c*. Hollow receivers 154*a*, 154*b* and 154*c* are configured to receive a portion of a display stand, such as a rod or similar hardware. For example, hollow receivers 154*a*, 154*b* and 154*c* could each received a mounting rod on a stand for supporting a mannequin.

Still further, shelf 100 includes a block 156 mounted to underside 112 of deck or main shelf body 102. Block 156 extends across width 114 of deck 102 and includes a plurality of apertures 158*a*, 158*b* and 158*c* (FIG. 2) that align with apertures 150*a*, 150*b* and 150*c*. Block 156 supports a length (of which length 160*b* is illustrated) of each hollow receiver 154*a*, 154*b* and 154*c*, which extend for greater distances than thickness 103 of deck 102.

Figure 13:
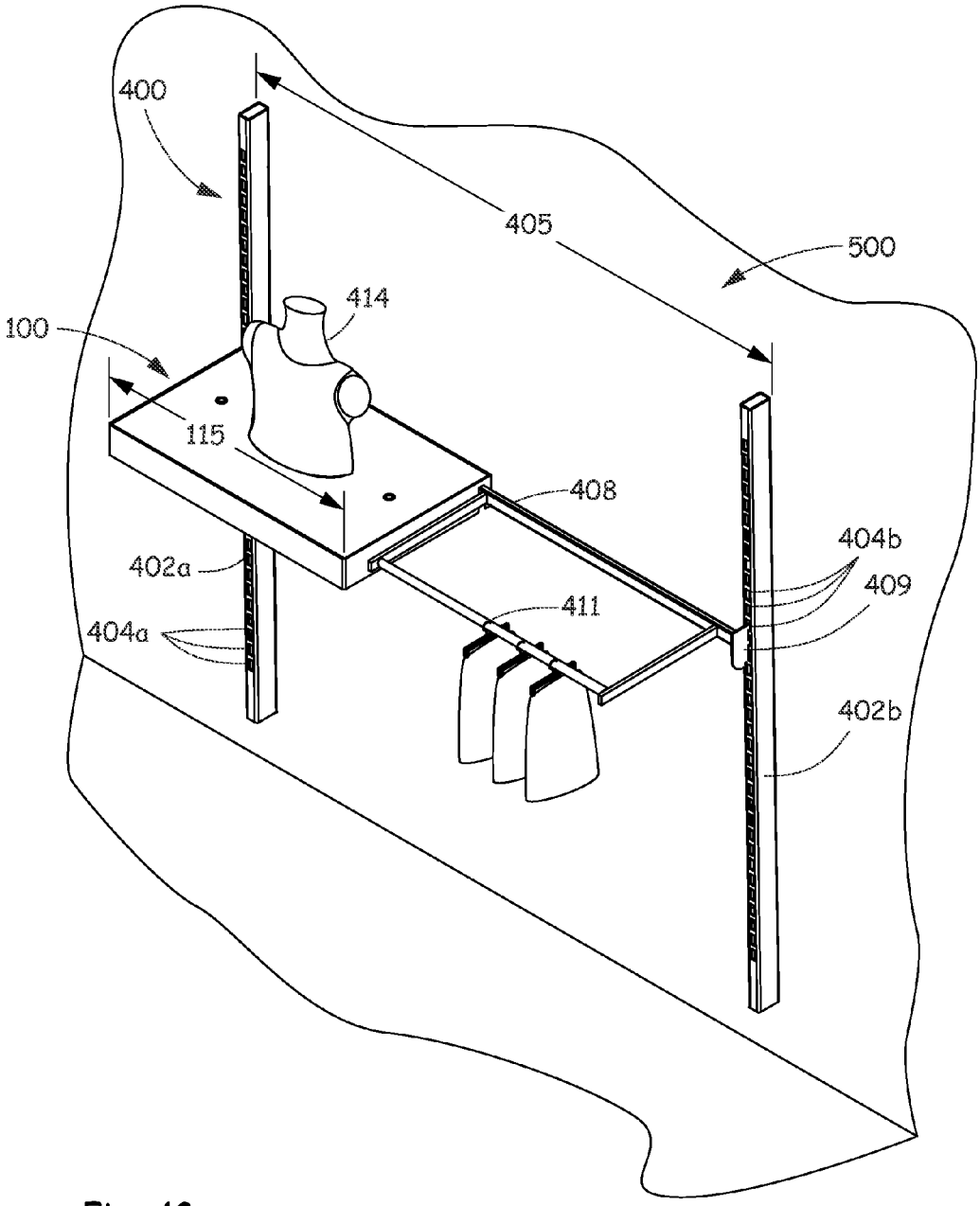
FIG. 13 is a perspective view of the shelf in FIG. 1 mounted to a display structure to form a display fixture according to yet another embodiment.

FIG. 13 is a perspective view of shelf 100 in FIGS. 1-8 mounted to an exemplary display structure 400 to form an exemplary display fixture 500 according to another embodiment. Exemplary display structure 400 is a wall. The wall is a fixed display structure that includes a plurality of frame members including at least two upright or substantially vertical frame members 402*a* and 402*b* separated from each other by a standard distance 405, such as four feet. Each upright frame member 402*a* and 402*b* includes a plurality of spaced apart holes 404*a* and 404*b*. Each of the plurality of holes 404*a* and 404*b* is capable of receiving a bracket on a cross bar or substantially horizontal rail. In FIG. 12, a cross bar or substantially horizontal rail 408 spans between the two upright frame members 402*a* and 402*b*. Upright frame member 402*a* receives a first bracket or first end 409 of cross bar or substantially horizontal rail 408 and upright frame member 402*b* receives a second bracket or second end (not illustrated in FIG. 12) of cross bar or substantially horizontal rail 408.

Openings 116 and 118 (not shown in FIG. 13) of shelf 100 as well as u-channel 110 (not shown in FIG. 13) are engaged with cross bar 408 without any additional hardware. Mounting shelf 100 to cross bar 408 as shown in FIG. 13 allows shelf 400 to be any width, such as width 115, that is the same or less than the length of cross bar 408 and the same or less than distance 405 between upright frame members 402*a* and 402*b*. In this way, shelf 100 need not be as wide as the distance between the upright frame members and the remaining length of cross bar 408 can be used to merchandise other types of product. In FIG. 12, a hanger bar 411 is mounted to the remaining length of cross bar 208 and supports hanging merchandise.

As illustrated in FIG. 13, display fixture 500 further includes a partial mannequin 414 that is securely held in hollow receiver 154*b* of shelf 100. Partial mannequin 414 may or may not display merchandise that is displayed on other display accessories, such as hanger bar 411.

The figures as discussed above also include a method of displaying merchandise on a display fixture, such as display fixture 300 or 500. At least one cross bar 208 or 408 is mounted to display structure 200 or 400 by inserting a first bracket or first end on cross bar 208 or 408 into holes 204*a* or 404*a* in a first upright 202*a* or 402*a* of display structure 200 or 400 and inserting a second bracket on cross bar 208 or 408 into holes 204*c* or 404*b* in a second upright 202*c* or 402*b* of display structure 200 or 400. Shelf 100 is mounted to cross bar 208 or 408 by engaging channel 110 located on underside 112 of deck 102 of shelf 100 with cross bar 208 or 408 without any additional hardware. Merchandise is then display on shelf 100 whether or not the merchandise is displayed on a mannequin, such as partial mannequin 414, which is mounted to hollow receiver 154*b* or whether the merchandise is supported directly by shelf 100. In addition, a display accessory, such as display accessory 211, 212 or 411 is mounted to cross bar 208 or 408 so as to support other merchandise other than the merchandise supported by shelf 100.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a display structure including at least two uprights and at least one cross bar that spans between the at least two uprights;

at least one shelf toollessly mounted on the at least one cross bar, the at least one shelf comprising:

a deck;

a pair of side panels each located on opposing sides of the deck and each having a slot, wherein each slot is separated from a back edge of each side panel; and an elongated channel extending between the pair of slots in the pair of side panels, the elongated channel being defined by a front that extends between front edges of the pair of slots, a back that extends between back edges of the pair of slots and a top that extends between upper edges of the pair of slots;

wherein the pair of slots and the elongated channel engage with the cross bar without any additional hardware so that the shelf is cantilevered from the cross bar to support merchandise; and wherein the shelf includes a plurality of apertures extending through a thickness of the deck, each aperture includes a hollow receiver that is configured to receive and securely hold a mannequin; wherein a block is mounted to an underside of the deck, the block includes a plurality of apertures that align with the plurality of apertures in the deck so as to support a length of each hollow receiver that extends for a greater distance than the thickness of the deck.

2. The display fixture of claim 1, wherein the at least two uprights comprise a plurality of spaced apart holes for receiving a first bracket located on a first end of the cross bar and a second bracket located on a second end of the cross bar.

3. The display fixture of claim 1, wherein the at least one shelf has a width that is less than a distance between the at least two uprights.

4. The display fixture of claim 1, wherein bottom edges of the front and the back of the elongated channel are located above bottom edges of the pair of side panels.

5. The display fixture of claim 1, wherein a distance between the front and the back of the elongated channel is less than a width of the slots in the pair of side panels at bottom edges of the pair of side panels.

6. A display fixture comprising: at least two upright support members; at least one substantially horizontal rail having a first end that mounts to one of the upright support members and a second end that mounts to another of the upright support members;

at least one shelf including a main shelf body, wherein a U-shaped rail defining a u-channel is coupled to an underside of the main shelf body and extends substantially across an entire width of the main shelf body, wherein the u-channel is engaged with the at least one substantially horizontal rail so that the at least one shelf is cantilevered from the at least one substantially horizontal rail;

wherein a right side of the u-channel is aligned with an upper portion of an opening in a right side frame member of the at least one shelf, a left side of the u-channel is aligned with an upper portion of an opening in a left side frame member of the at least one shelf, such that a distance between a front of the u-channel and a back of the u-channel is substantially similar to widths of the upper portions of the openings in the right side frame member and the left side frame member and the front of the u-channel extends between front edges of the openings in the right side frame member and the left side frame member and the back of the u- channel extends between back edges of the openings in the right side frame member and the left side frame member;

wherein the u-channel is spaced apart from a back edge of the shelf and in closer proximity to the back edge of the shelf than a front of the shelf; and wherein the widths of the upper portions of the openings in the right and left side frame members are less than widths of where the openings in the right and left side frame members intersect bottom edges of the right and left side frame members to guide the at least one shelf to sit on the at least one substantially horizontal rail.

7. The display fixture of claim 6, wherein the u-channel and the openings in the right and left side frame members engage with the at least one substantially horizontal rail without any additional hardware.

8. The display fixture of claim 6, further comprising a plurality of apertures extending through a thickness of the main shelf body, each aperture includes a hollow receiver for receiving a portion of a display stand.

9. The display fixture of claim 8, further comprising a mannequin including a mounting rod for being securely held in the hollow receiver of one of the apertures located through the thickness in the main shelf body.

10. The display fixture of claim 8, further comprising a block mounted to an underside of the main shelf body and including a plurality of apertures that align with the plurality of apertures in the main shelf body so as to support a length of the each hollow receiver that extends for a greater distance than the thickness of the main shelf body.

11. The display fixture of claim 6, wherein the at least one shelf has a width that is less than a distance between the at least two upright support members.

12. The display fixture of claim 6, wherein bottom edges of the front and the back of the u-channel are located above bottom edges of the right and left side frame members.

13. A display fixture comprising:

a display structure including at least two uprights and at least one cross bar that spans between the at least two uprights;

at least one shelf toollessly mounted on the at least one cross bar, the at least one shelf comprising:

a deck having a top surface and a bottom surface;

a pair of side panels each extending downwardly from opposing sides of the deck and each having a slot, wherein each slot is separated from a back edge of each side panel; and a front panel extending downwardly from a front edge of the deck; wherein the side panels and the front panels are combined to form a border; wherein a cavity is defined from the underside of the shelf by the border and the deck;

wherein the cavity defined by the corresponding panels is configured to receive a support beam that is configured to be mounted to the bottom surface of the deck within the cavity;

an elongated channel extending between the pair of slots in the pair of side panels, the elongated channel being defined by a front that extends between front edges of the pair of slots, a back that extends between back edges of the pair of slots and a top that extends between upper edges of the pair of slots;

wherein the pair of slots and the elongated channel engage with the cross bar without any additional hardware so that the shelf is cantilevered from the cross bar to support merchandise; and wherein the shelf includes a plurality of apertures extending through a thickness of the deck, a mannequin mounted to the shelf using a post that is inserted within an aperture in the deck.

14. The display fixture of claim 13, further comprising a display accessory mounted onto the at least one cross bar and next to the shelf so as to support additional merchandise other than merchandise displayed by the shelf.

15. The display fixture of claim 13, wherein the shelf has a width that is less than a width between the first upright and the second upright.

* * * * *